US007760061B2

(12) United States Patent
Varga et al.

(10) Patent No.: US 7,760,061 B2
(45) Date of Patent: Jul. 20, 2010

(54) LAMP TRANSFORMER

(75) Inventors: Viktor K. Varga, Solon, OH (US); Bruce Roberts, Mentor on the Lake, OH (US)

(73) Assignee: General Electric Company, Schenectady, NY (US)

( * ) Notice: Subject to any disclaimer, the term of this patent is extended or adjusted under 35 U.S.C. 154(b) by 777 days.

(21) Appl. No.: 11/513,777

(22) Filed: Aug. 31, 2006

(65) Prior Publication Data

US 2008/0055879 A1 Mar. 6, 2008

(51) Int. Cl.
*H01F 27/02* (2006.01)

(52) U.S. Cl. ..... 336/90; 336/192

(58) Field of Classification Search ..... 336/836, 336/90, 61, 155, 192; 315/56, 58, 276
See application file for complete search history.

(56) References Cited

U.S. PATENT DOCUMENTS

| | | | | |
|---|---|---|---|---|
| 4,156,222 | A * | 5/1979 | Rossman et al. | 336/61 |
| 4,677,348 | A | 6/1987 | Schweickardt | |
| 4,902,943 | A | 2/1990 | Nicholson et al. | |
| 5,122,174 | A | 6/1992 | Sunder et al. | |
| 5,159,242 | A | 10/1992 | Ravi | |
| 5,185,560 | A | 2/1993 | Nilssen | |
| 5,228,770 | A | 7/1993 | Brunson | |
| 5,485,057 | A | 1/1996 | Smallwood et al. | |
| 5,510,967 | A | 4/1996 | Coushaine et al. | |
| 5,600,208 | A | 2/1997 | Katou et al. | |
| 5,659,221 | A | 8/1997 | Coushaine et al. | |
| 5,828,174 | A | 10/1998 | Seiler et al. | |
| 5,838,109 | A | 11/1998 | Kobayashi et al. | |
| 5,892,332 | A | 4/1999 | Drews et al. | |
| 5,894,202 | A | 4/1999 | Betz et al. | |
| 6,154,113 | A | 11/2000 | Murai | |
| 6,194,834 | B1 | 2/2001 | Seiler et al. | |
| 6,364,515 | B1 | 4/2002 | Daub et al. | |
| 6,583,585 | B2 | 6/2003 | Takeda et al. | |
| 6,624,596 | B1 | 9/2003 | Ohsawa et al. | |
| 6,641,418 | B2 | 11/2003 | Takahashi et al. | |
| 6,731,076 | B1 | 5/2004 | Gerhard et al. | |
| 6,894,429 | B2 | 5/2005 | Tsuda et al. | |
| 7,042,169 | B2 | 5/2006 | Neumeier et al. | |
| 2004/0125534 | A1 | 7/2004 | Takiguchi et al. | |

FOREIGN PATENT DOCUMENTS

| | | | |
|---|---|---|---|
| DE | 197 51 548 | C2 | 6/1999 |
| DE | 100 33 571 | C2 | 1/2002 |
| EP | 0 515 958 | B1 | 3/1995 |
| EP | 0 786 791 | B1 | 11/1999 |
| EP | 1 052 447 | A2 | 11/2000 |
| EP | 1 077 590 | A2 | 2/2001 |
| EP | 0 852 455 | B1 | 5/2002 |
| EP | 0 902 605 | B1 | 6/2003 |
| EP | 0 975 007 | B1 | 1/2004 |
| WO | WO 2004/066686 | A1 | 8/2004 |
| WO | WO 2005/045878 | A2 | 5/2005 |
| WO | WO 2006/027268 | A1 | 3/2006 |

* cited by examiner

*Primary Examiner*—David Hung Vu
(74) *Attorney, Agent, or Firm*—Fay Sharpe LLP

(57) ABSTRACT

Disclosed is a lamp transformer and method of assembling a lamp transformer within an igniter module or housing. The lamp transformer comprising a potted bar core transformer; and a carrier attached to the potted bar core transformer, the carrier adapted to position the potted bar core transformer on a pc board at a predetermined location.

16 Claims, 7 Drawing Sheets

LAMP TRANSFORMER

BACKGROUND OF THE INVENTION

This disclosure relates to a high voltage igniter module used to ignite a lamp, for example a HID (High Intensity Discharge) lamp. Specifically, the disclosure relates to the mechanical design of a high voltage transformer and the associated igniter module.

Conventionally, high voltage igniter circuits are used to start HID lamps. One example of a HID lamp requiring a high voltage ignition is an automotive lamp commonly referred to as a head light. To produce the high voltage ignition signal, an igniter circuit is operatively connected to the HID lamp. Conventional configurations of an automotive headlamp assembly include an igniter circuit housed within the HID lamp assembly, the igniter circuit including a pc board and a transformer. The igniter printed circuit board carries electrical components to produce a high voltage ignition signal. In addition, the pc board provides electrical connection points to power the ignition circuit and deliver the high voltage ignition signal to a HID lamp.

One example of a conventional embodiment of a high voltage igniter circuit includes a lamp receptacle mounted to the igniter circuit pc board. In addition, it is common to mount the igniter circuit transformer either directly to the pc board or separate from the pc board. In the later case, the transformer may be mounted to the lamp housing where the pc board provides the necessary winding connection points.

As previously indicated, this disclosure relates to the mechanical design of the igniter module transformer. Conventionally, high voltage igniter transformers have been used to produce the high voltage signals necessary to provide an ignition signal. In general, the igniter transformer includes a magnetic core, a secondary winding surrounding the magnetic core and a primary winding surrounding the secondary core. The output voltage associated with the secondary winding is related to the ratio of the number of secondary windings to the number of primary windings.

During the assembly of a HID lamp, it is common practice to pot the transformer with an insulating material to provide electrical insulation of the windings from other electrical components contained within the lamp housing. In addition, potting of the transformer increases the overall stability of the transformer's performance. One drawback associated with potting of the transformer is the necessary step of characterization of the transformer subsequent to potting.

Conventionally, the characterization of an igniter transformer occurs after the igniter module has been fully assembled or the transformer has been mounted within a lamp housing chamber separate from the pc board. In the first case, the igniter pc board carries all electrical components associated with the igniter circuit, including the transformer. Subsequent to the assembly of the pc board, the pc board is potted. Characterization of the transformer is performed with the transformer mounted and potted on the completed pc board assembly. In the event the characterization of the potted igniter transformer is not within the required specifications, the entire pc board is discarded or extensive rework is required to remove the potting material to replace the transformer.

In the second case, the igniter transformer is mounted and potted within a separate chamber of the lamp housing. The transformer is characterized subsequent to mounting and potting within the lamp housing. In the event the characterization of the igniter transformer is not within the required specification, the housing and transformer assembly are discarded or extensive rework is required to remove the potted transformer from the housing to replace the transformer.

This disclosure provides an igniter module and associated transformer to enable characterization of the transformer prior to the assembly of the transformer within the lamp housing or mounting of the transformer to an igniter pc board. The disclosed igniter module eliminates the need to discard/rework a pc board or housing as previously discussed if the characterization of an igniter transformer is determined to be out of specification subsequent to potting.

BRIEF DESCRIPTION OF THE INVENTION

According to one aspect of this disclosure, an exemplary embodiment of a lamp transformer is disclosed. The lamp transformer comprises a potted bar core transformer; and a carrier attached to the potted bar core transformer, the carrier adapted to position the potted bar core transformer on a pc board at a predetermined location.

According to another aspect of this disclosure, a lamp igniter module is disclosed. The lamp igniter module comprises a housing, a pc board and a potted igniter transformer attached to the pc board. The potted igniter transformer is characterized before being attached to the pc board; wherein the pc board and attached potted igniter transformer are attached to the housing.

According to another aspect of this disclosure, a method of assembling a lamp is disclosed. The method of assembling a lamp comprises of potting one or more igniter transformers mounted to one or more respective carriers; characterizing the one or more potted igniter transformers to determine if the potted igniter transformers are within acceptable tolerances and proceeding with the assembly of the lamp using a potted igniter transformer within acceptable tolerances; and positioning the carrier on an igniter circuit pc board using locator pins attached to the carrier and/or the pc board.

DETAILED DESCRIPTION OF THE INVENTION

This disclosure provides a mechanical design of a high voltage transformer and an associated igniter module for a gas discharge lamp, especially for automotive lamp products. Substantively, the module design comprises a printed circuit board (PCB) with low voltage electronic components inserted into the PCB and a pre-assembled high voltage core transformer encased in a high voltage potting material. The high voltage core transformer is mounted on the PCB by means of a carrier.

The pre-potting of the high voltage core transformer before attachment to the PCB provides an opportunity to discard a potted high voltage core transformer without discarding the PCB or associated housing in the event the characterization of the potted core transformer is not within acceptable tolerances. In other words, the required characterization of the potted high voltage transformer is performed before the transformer is attached to the PCB or mounted within the igniter module housing. This design and embodiments thereof is distinguishable from the prior art which requires potting of an igniter module high voltage transform after the transformer is attached to an igniter PCB or mounted within an igniter module chamber. As discussed in the background section of this disclosure, characterization of the high voltage transformer occurs subsequent to potting of the transformer. Accordingly, the prior art ignition module requires a potted PCB with attached transformer, or lamp housing with potted transformer to be discarded in the event the transformer's characterization is not within acceptable tolerances.

Figure 1:
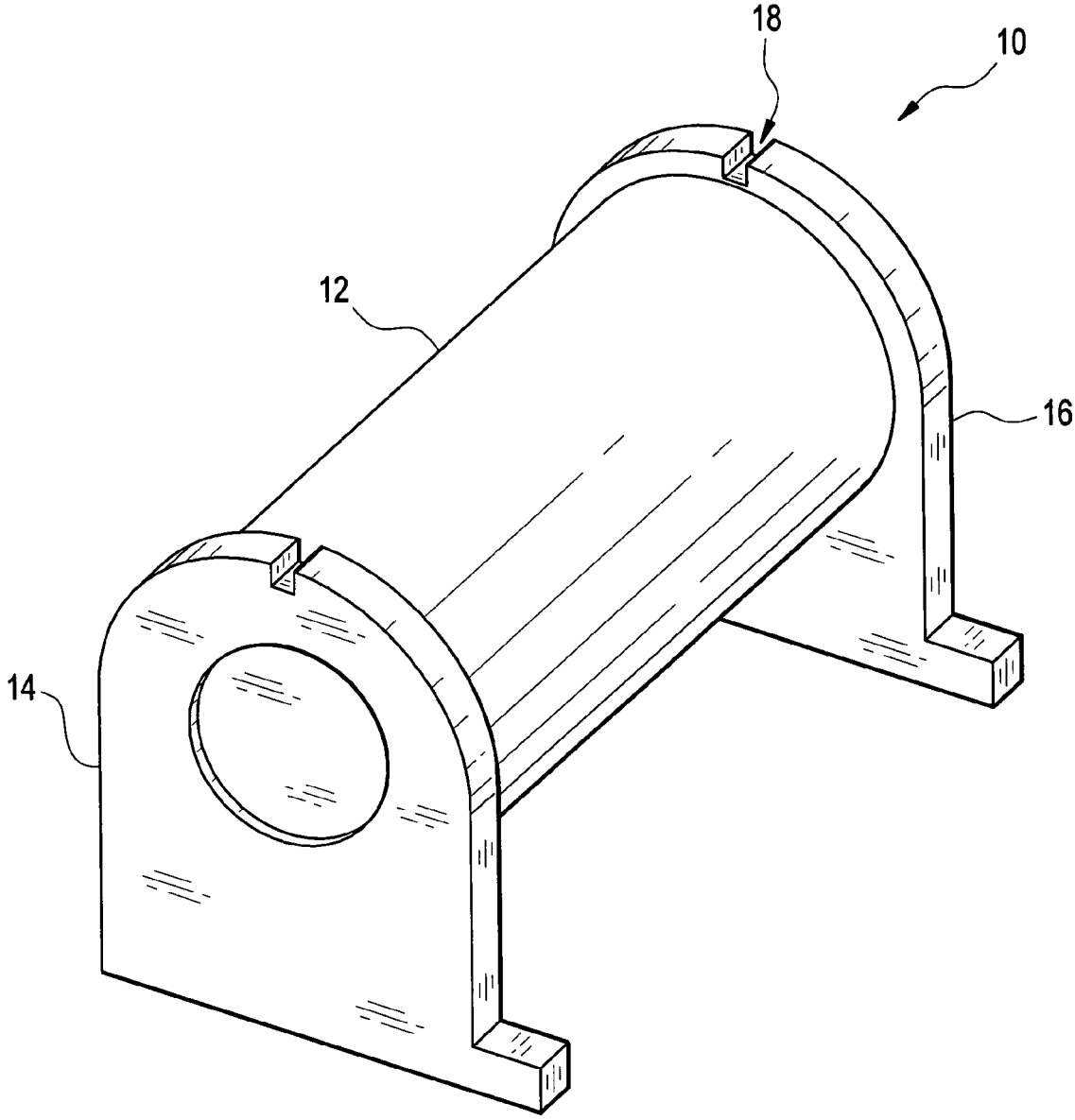
FIG. 1 illustrates a lamp igniter transformer according to an exemplary embodiment of this disclosure.

With reference to FIG. 1, illustrated is a perspective view of a potted bar core transformer assembly 10 according to an exemplary embodiment of this disclosure. The transformer assembly 10 comprises a potted core transformer 12, a first carrier end part 14, and a second carrier end part 16. The carrier end parts include slots 17 and 18 which provide positioning of the potted bar core transformer assembly within a housing (not shown).

In one exemplary embodiment, the bar core transformer includes a rod shaped core. However, other core shapes are within the scope of this disclosure. The carrier end parts 14 and 16 are made of a high temperature plastic, for example, PPS or ULTEM. The carrier end parts 14 and 16 perform three functions when attached to the longitudinal ends of the core material. They function as bobbin walls to efficiently wind the transformer core using a maximum length of the core. In addition, the carrier end parts 14 and 16 function as support for an insulating material positioned between a mold and the carrier end part, the mold holding the transformer potting material while it is curing. Finally, the carrier end parts 14 and 16 function as positioners of the potted bar core transformer within a housing (not shown).

The transformer illustrated in FIG. 1 is potted after the transformer winding process by casting the wound transformer in a lined mold. Subsequent to the curing of the potting material, a full characterization and testing of the potted bar core transformer 10 is completed. Notably, this characterization and testing of the potted bar core transformer 10 occurs prior to any further assembly of the igniter module, thereby avoiding discardmerit and/or rework of a more completed igniter module assembly in the event the potted bar core transformer does not meet tolerances related to the said characterization and testing.

Figures 2A, 2B:
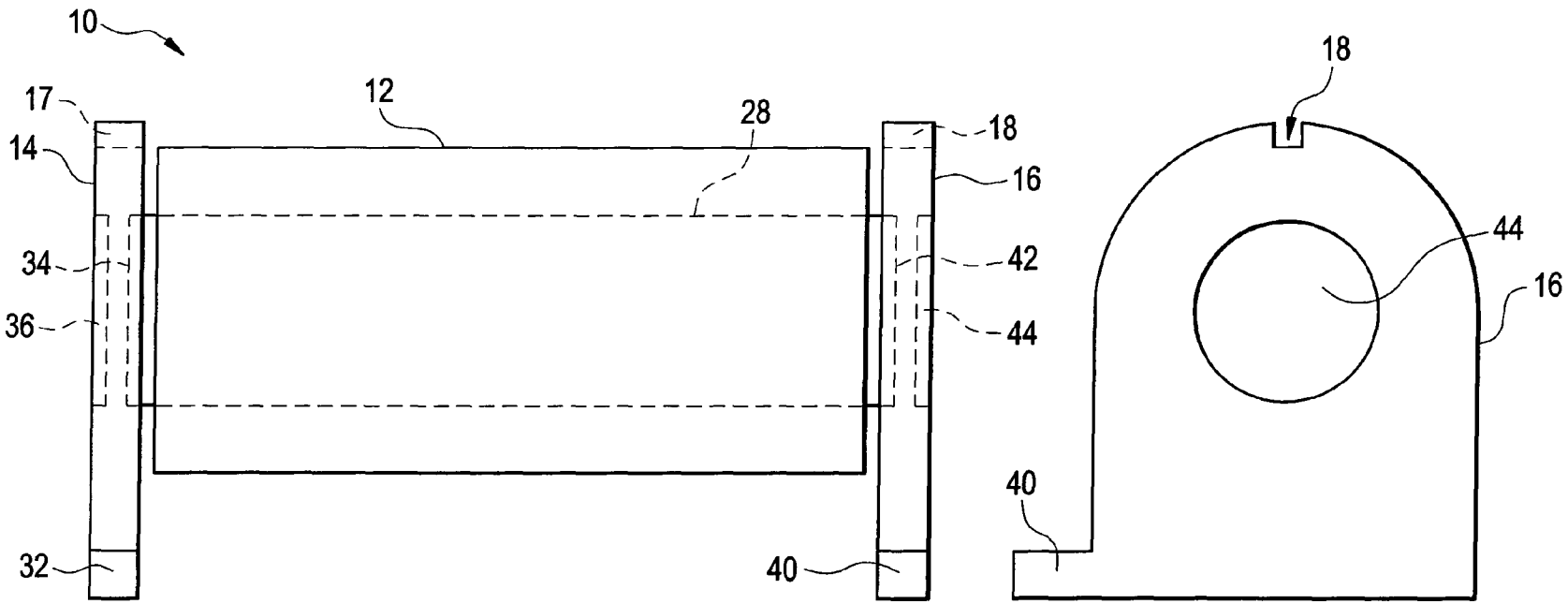
FIG. 2A and FIG. 2B illustrate a front and side view, respectively, of a lamp igniter transformer according to an exemplary embodiment of this disclosure.

With reference to FIG. 2A and FIG. 2B, illustrated are a front and end view, respectively, of a potted bar core transformer assembly 20 according to an exemplary embodiment of this disclosure. The potted bar core transformer assembly 20 comprises a potted bar core transformer 22, a first carrier end part 24, and a second carrier end part 26. The potted bar core transformer 22 comprises a bar core 28. The first carrier end part 24 comprises a carrier end part slot 30, a carrier end part tab 32, an inner recess 34 and an outer recess 36. Similarly, the second carrier end part 26 comprises a carrier end part slot 38, a carrier end part tab 40, an inner recess 42 and an outer recess 44. The carrier inner recesses 34 and 42 attach to the longitudinal ends of the transformer core 28, for example by means of a pressed fit or adhesive. Notably, the carrier outer recesses 36 and 44 enable the same carrier end part to be used at either end of the transformer core 28.

Figure 3:
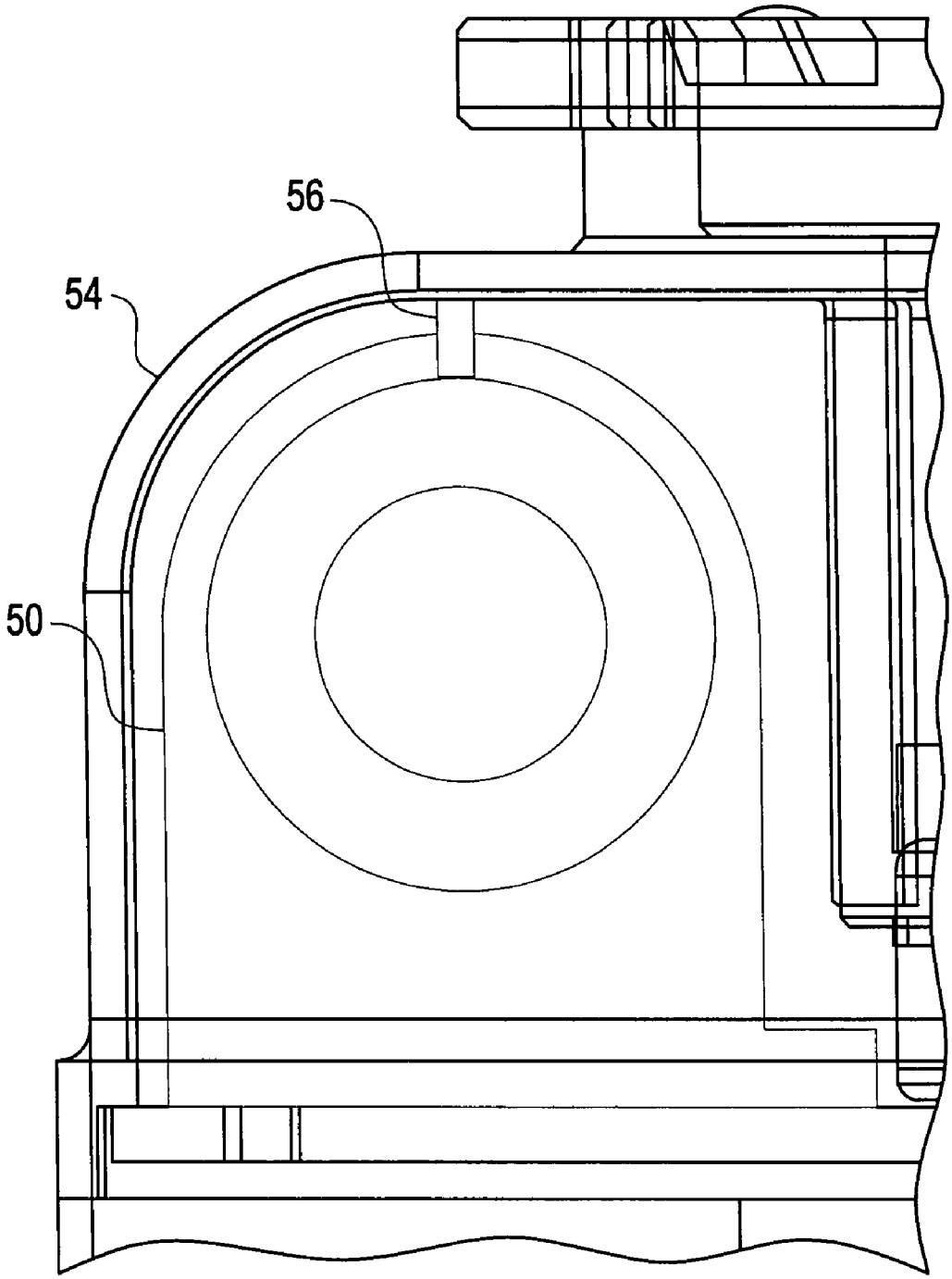
FIG. 3 illustrates the placement of an igniter transformer and carrier within a housing, according to an exemplary embodiment of this disclosure.

With reference to FIG. 3, illustrated is an end view 50 of a potted bar core transformer assembly mounted within a housing 54. The housing 54 comprises a housing locator tab 56 which mates with the carrier end part 52 slot 38 as previously discussed with reference to FIGS. 2A and 2B.

With reference to FIGS. 4A-4I, illustrated is a series of process steps to assemble an igniter module and associated lamp according to an exemplary embodiment of this disclosure.

Figure 4A:
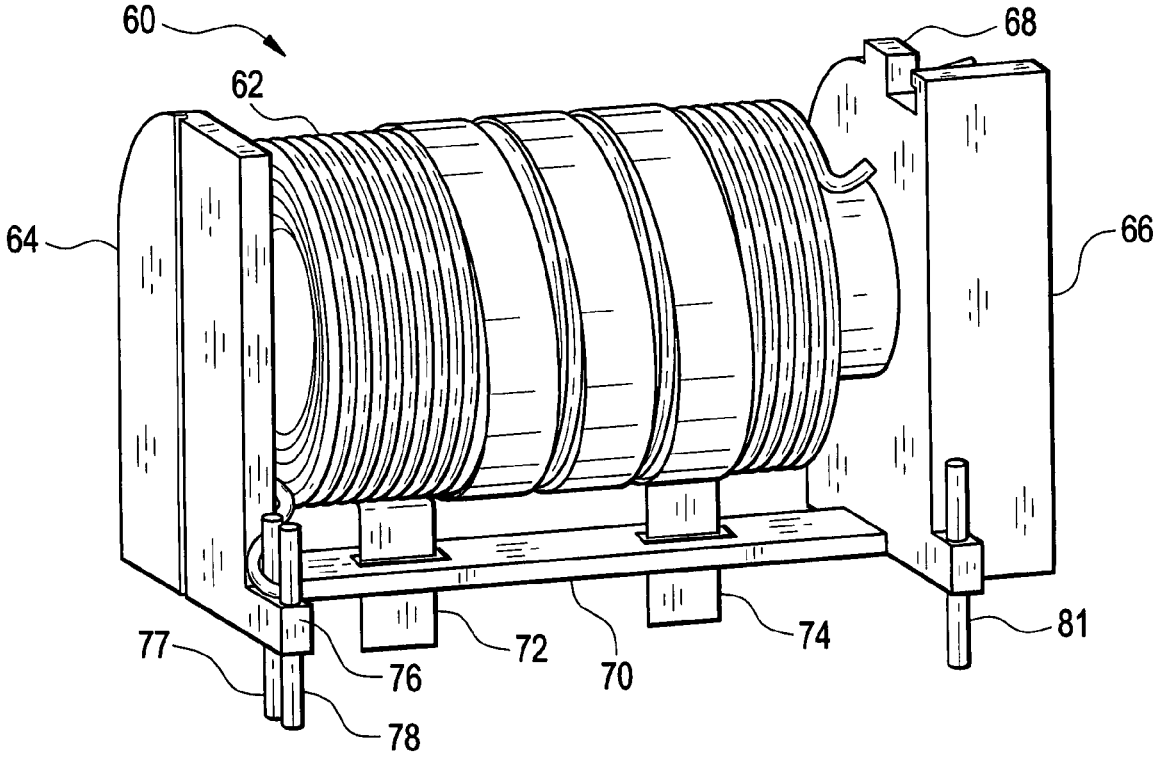
FIGS. 4A through 4I illustrate the assembly steps associated with a lamp assembly according to an exemplary embodiment of this disclosure.

With reference to FIG. 4A, illustrated is a bar core transformer assembly representing the initial stage 60 of assembly of an igniter module according to an exemplary embodiment of this disclosure. The bar core transformer assembly comprises a bar core transformer 62, a first carrier end part 64, a second carrier end part 66 and a carrier transformer lead guide 70. The first carrier end part 64 comprises a carrier locator pin tab 76 and the attached carrier locator pins 77 and 78. Similarly, the second carrier end part 66 comprises a carrier locator pin tab 79 and an attached carrier locator pin 81. In addition to providing a means for attachment of the carrier end parts to the PCB in a subsequent assembly step, the carrier locator pins can provide electrical connection points for the primary winding wires and/or secondary winding wires associated with the transformer. For example, a bar core transformer assembly without a carrier transformer lead guide can be configured to electrically connect the primary winding lead wires to two separate metal locator pins, such as locator pins 77 and 81. The secondary winding lead wires can be connected to a third and fourth locator pin or alternatively a combination of a locator pins 81 for a first secondary winding lead connection and simply routing the second secondary winding lead through a hole provided on the second carrier end port 66. Notably, this disclosure is not limited to a particular configuration of the carrier locator pins or carrier feed through holes associated with electrically connecting the transformer windings to a PCB or other connection point.

Figure 4B:
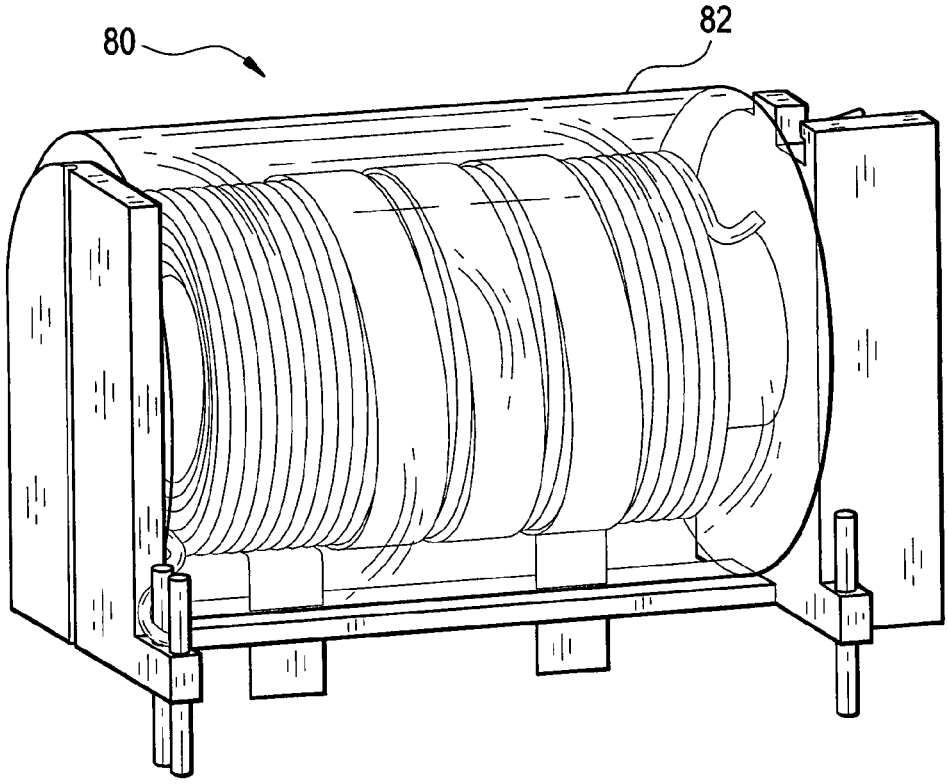

With reference to FIG. 4B, illustrated is step two 80 of assembling the igniter module according to an exemplary embodiment of this disclosure. The second step 80 comprising potting the transformer bar core and windings with an insulating material, for example a silicone or epoxy material.

Figure 4C:
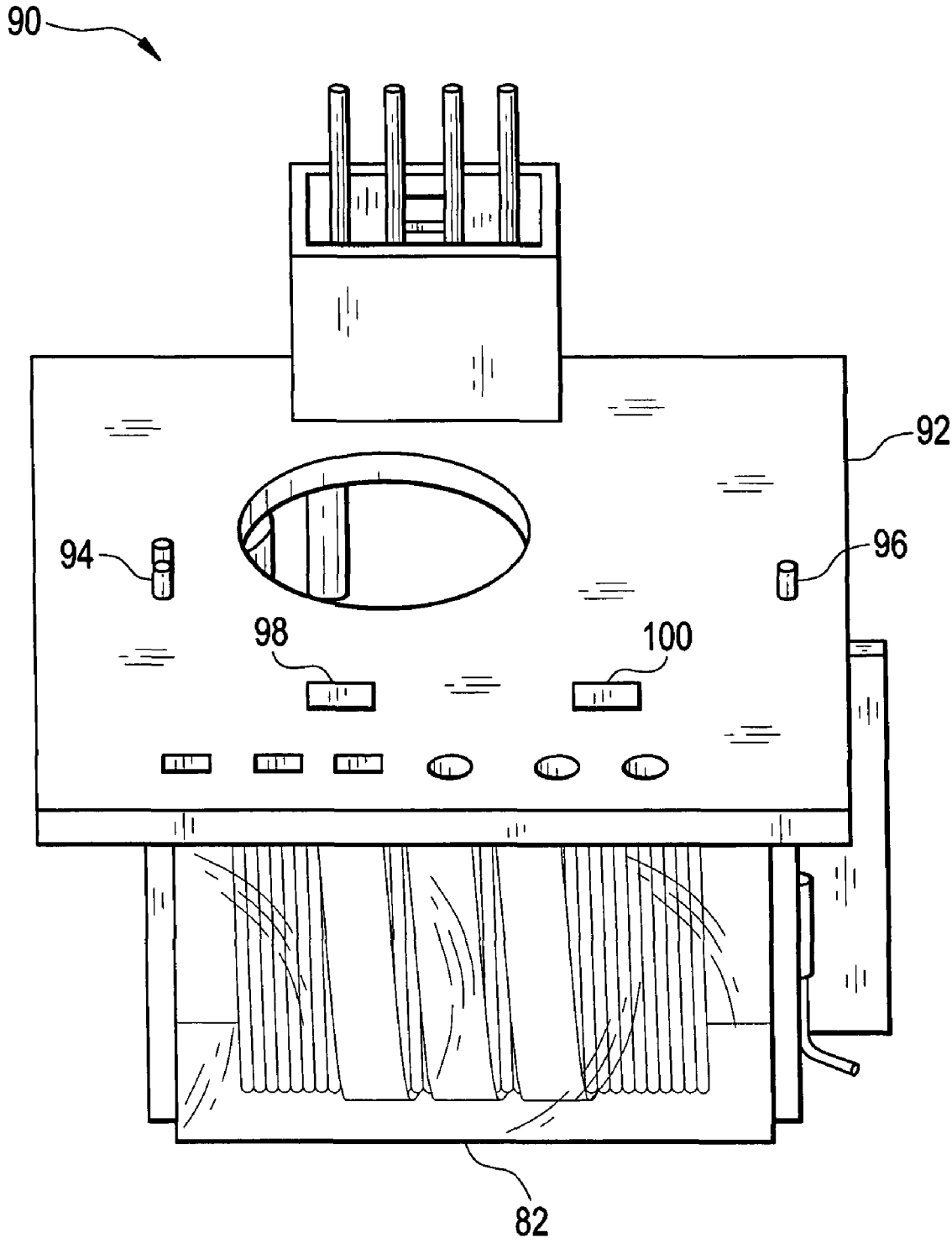

With reference to FIG. 4C, illustrated is step three 90 of assembling the igniter module. The third step comprising the electrical connection of the potted transformer leads 72 and 74 to the PCB 92 at transformer lead connection points 98 and 100, for example by means of soldering. In addition, the potted bar core transformer 82 and carrier are attached to the PCB at the PCB carrier locator pin receivers 94 and 96, for example by means of soldering.

Figure 4F:
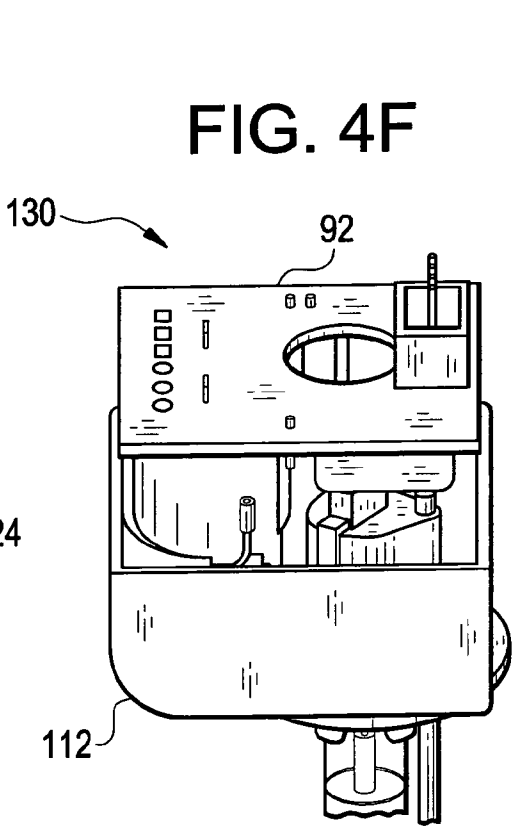
Figure 4E:
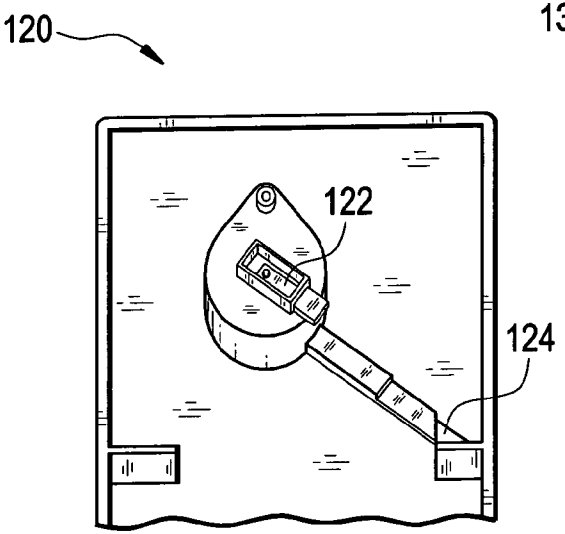
Figure 4D:
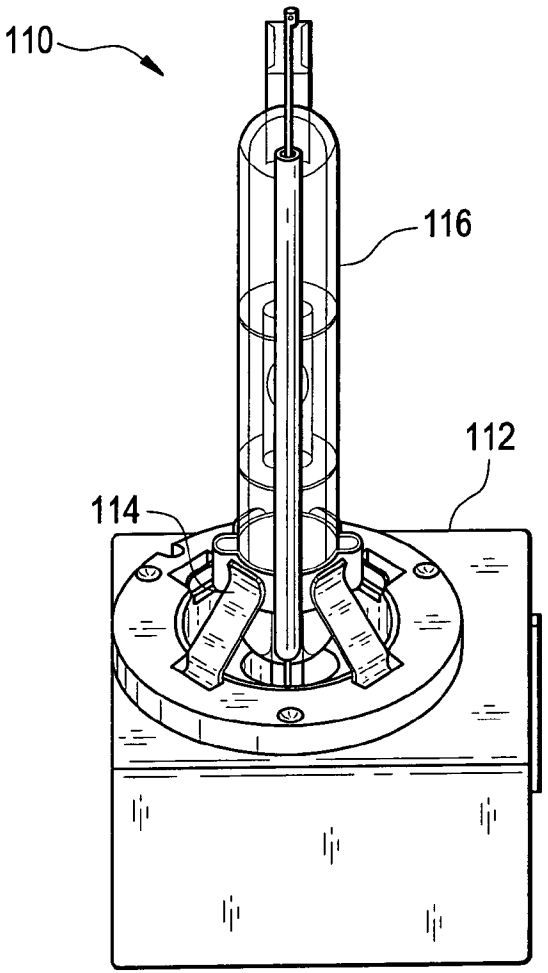

With reference to FIG. 4D, illustrated is step four 110 of assembling the igniter module according to an exemplary embodiment of this disclosure. The fourth step comprising inserting a lamp 116 into the lamp receptacle 114 attached to a housing 112 and threading the lamp leads (not shown) into the housing.

With reference to FIG. 4E, illustrated is step five 120 of assembling the igniter module according to an exemplary embodiment of this disclosure. The fifth step comprising the electrical connection of a first lamp lead to the metal strip 122 located on the inside of the housing. Notably, a metal strip continuity point 124 is provided as illustrated. Connection of the lamp lead may include laser welding, soldering or other means for electrically connecting an electrical lead and metal strip.

With reference to FIG. 4F, illustrated is step six 130 of assembling the igniter module according to an exemplary embodiment of this disclosure. The sixth step comprising inserting the completed PCB 92 into the housing 112 and electrically connecting a second lamp lead (not shown) to the PCB.

Figure 4I:
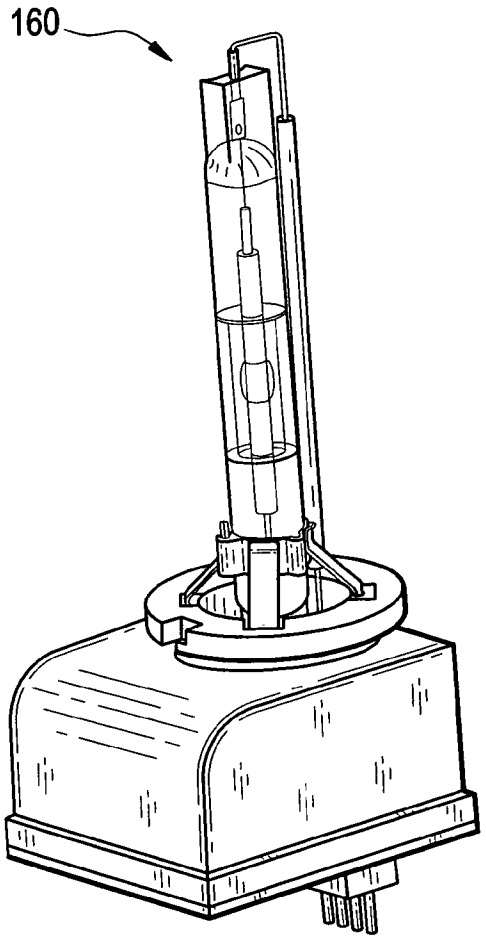
Figure 4H:
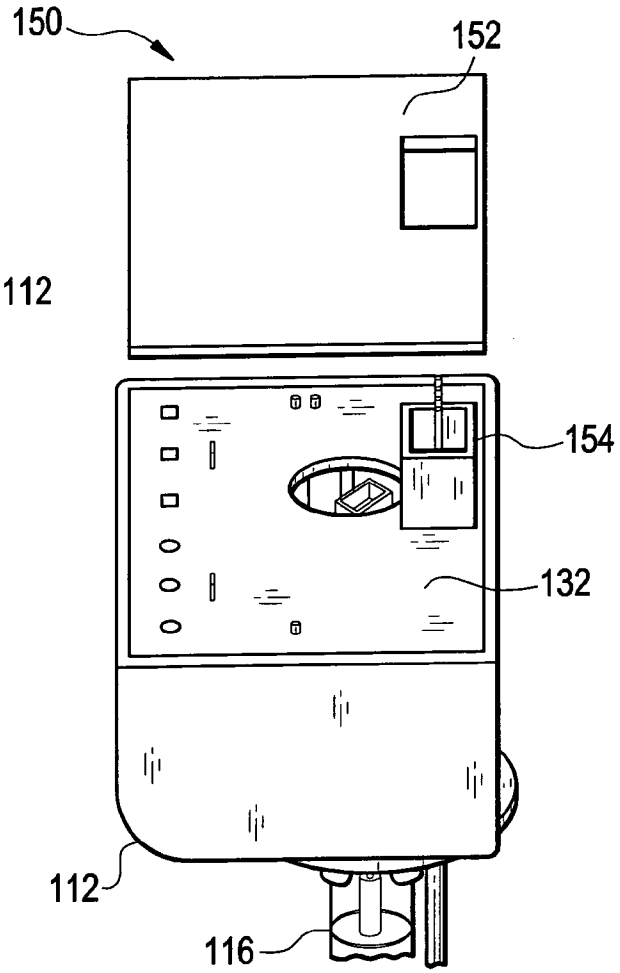
Figure 4G:
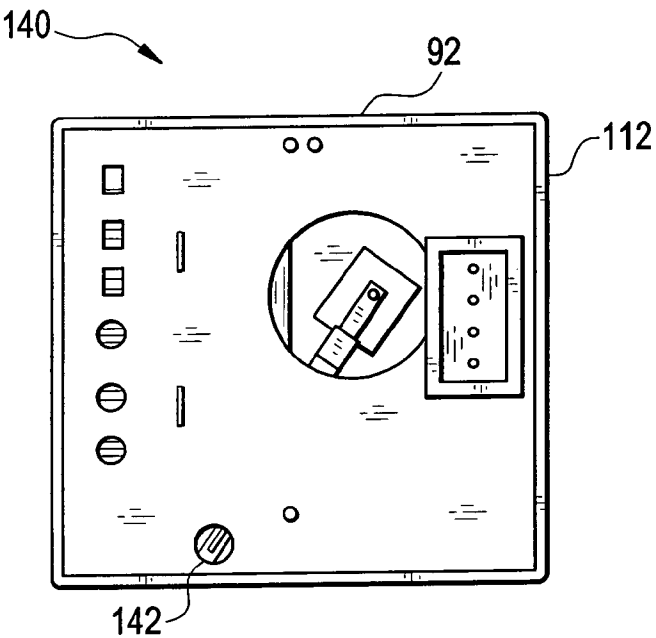

With reference to FIG. 4G, illustrated is step seven 140 of assembling the igniter module according to an exemplary embodiment of this disclosure. The seventh step comprising the electrical connection of a potted bar core transformer primary winding lead to a metal strip 142 molded in the housing 112, where the PCB 92 provides the necessary access hole to reach the metal strip 142.

With reference to FIG. 4H, illustrated is step eight 150 of assembling the igniter module according to an exemplary embodiment of this disclosure. The eighth step comprising locating a bottom cover 152 over the PCB 132 connector 154 and attaching the said bottom cover 152 with glue or other means for mechanical attachment.

With reference to FIG. 4I, illustrated is a perspective view of an assembled igniter module including a lamp according to an exemplary embodiment of this disclosure.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp transformer comprising:

a potted bar core transformer having a core with windings wound therearound; and a carrier attached to the potted bar core transformer, the carrier adapted to position the potted bar core transformer on a pc board at a predetermined location, the carrier including first and second end parts supporting first and second longitudinal ends, respectively, of the core therebetween, and the end parts having perimeter portions that extend beyond an entire perimeter surface of the core.

2. The lamp transformer according to claim 1, wherein the carrier is adapted to position the bar core transformer for potting prior to placement of the lamp transformer on a pc board or within a lamp housing.

3. The lamp transformer according to claim 1, wherein the core is cylindrical.

4. The lamp transformer according to claim 3, wherein the first and second end parts extend and are adapted to provide support for the bar core transformer potting material.

5. The lamp transformer according to claim 4, the carrier first and second end parts further comprising one or more carrier locator pins to position the lamp transformer on a pc board.

6. The lamp transformer according to claim 5, where the one or more carrier locator pins position the bar core transformer on a potting fixture.

7. The lamp transformer according to claim 3, wherein one or both of the carrier ends are adapted to position the lamp transformer within a housing at a predetermined location.

8. The lamp transformer according to claim 7, wherein one or both of the carrier end parts comprises a tab protruding from the carrier end part to position the lamp transformer within a housing at a predetermined location.

9. The lamp transformer according to claim 1 further comprising:

a first and second end part, the first and second end parts attached to a first and second end, respectively, of the bar core.

10. A lamp igniter module comprising:

a housing;

a pc board; and a potted igniter transformer attached to the pc board, wherein the potted igniter transformer is potted before being attached to the pc board, a carrier attached to the potted bar core transformer wherein the carrier includes first and second end parts supporting first and second longitudinal ends, respectively, of a core therebetween, and the end parts having perimeter portions that extend beyond an entire perimeter surface of the core, wherein the pc board and attached potted igniter transformer are attached to the housing.

11. The lamp igniter module according to claim 10, the potted igniter transformer further comprising:

the carrier adapted to position the bar core transformer for potting prior to placement of the lamp transformer on a pc board or within a lamp housing.

12. The lamp igniter module according to claim 10, wherein:

first and second end parts comprising alignment pins to locate the lamp transformer on a pc board.

13. The lamp igniter module according to claim 12, the potted igniter transformer carrier further comprising:

alignment pins which locate the bar core transformer on a potting fixture.

14. The lamp igniter module according to claim 10, wherein one or both of the carrier end parts are adapted to position the lamp transformer within a housing at a predetermined location.

15. The lamp igniter module according to claim 14, wherein one or both of the carrier end parts comprises a tab protruding from the carrier end part to position the lamp transformer within a housing at a predetermined location.

16. The lamp igniter module according to claim 10, the potter igniter transformer further comprising:

a primary winding lead adapted to connect to a pc board and a secondary winding lead adapted to connect to a pc board.

* * * * *